United States Patent [19]

Colton

[11] Patent Number: 4,721,252

[45] Date of Patent: Jan. 26, 1988

[54] HOT-MELT SPUTTERING APPARATUS

[75] Inventor: Douglas E. Colton, Salinas, Calif.

[73] Assignee: Slautterback Corporation, Monterey, Calif.

[21] Appl. No.: 863,088

[22] Filed: May 14, 1986

Related U.S. Application Data

[63] Continuation-in-part of Ser. No. 704,892, Feb. 22, 1985, Pat. No. 4,602,741, which is a continuation of Ser. No. 493,710, May 11, 1983, abandoned.

[51] Int. Cl.[4] ..... B05B 1/14; B05B 7/06; B05B 7/16

[52] U.S. Cl. ..... 239/424.5; 239/8; 239/135; 239/557; 118/315

[58] Field of Search ..... 239/79, 83, 135, 137, 239/138, 416.5, 417, 417.3, 423, 424, 552, 562, 556–558, 568, 13, 128, 132.5, 8, 424.5, 549; 118/DIG. 3, 315, 410–414; 222/146.1–146.3, 146.5, 603

[56] References Cited

U.S. PATENT DOCUMENTS

| | | | |
|---|---|---|---|
| 905,250 | 12/1908 | Truman . | |
| 1,082,314 | 12/1913 | Gabrys | 222/146.1 X |
| 2,551,538 | 5/1951 | Hensel | 239/424 |
| 3,237,870 | 3/1966 | McCartney et al. | 239/424 |
| 3,303,972 | 2/1967 | Van Loben Sels | 239/566 X |
| 3,341,124 | 9/1967 | Barnes | 239/8 |
| 3,348,520 | 10/1967 | Lockwood | 118/2 |
| 3,387,783 | 6/1968 | Schellenberg et al. | 239/81 |
| 3,406,905 | 10/1968 | Reilly et al. | 239/84 |
| 3,602,434 | 8/1971 | Hruby, Jr. | 239/424 |
| 3,661,679 | 5/1972 | Law | 239/586 X |
| 3,741,484 | 6/1973 | Cresswell | 239/424 |
| 3,976,247 | 8/1976 | Carmelo | 239/135 |
| 3,981,123 | 9/1976 | Flanagan | 118/DIG. 3 X |
| 4,031,854 | 6/1977 | Sprague, Jr. | 118/641 |
| 4,065,057 | 12/1977 | Durmann | 239/79 |
| 4,592,507 | 6/1986 | Benedict | 239/551 X |
| 4,602,741 | 7/1986 | Faulkner et al. | 222/146.2 X |
| 4,610,760 | 9/1986 | Kirkpatrick et al. | 239/424 X |
| 4,643,854 | 4/1982 | Kendall | 239/424 X |

*Primary Examiner*—Andres Kashnikow
*Assistant Examiner*—Kevin Patrick Weldon

[57] ABSTRACT

A hot-melt adhesive dispenser having spray nozzles connected to a nozzle manifold receiving hot-melt adhesive material from a heated dispenser head. The spray nozzles have a pair of flow paths, one within the other, terminating near the nozzle outlet. A stream of low pressure air flows from a valve, through a plurality of tubes to at least one hollow gas injection conduit in the nozzle forming an inner flow path. Hot-melt material flows through a dispensing bar to a nozzle body cavity and opening defining the outer flow path. Hot-melt material is projected from the nozzle, broken up into droplets by the expanding gas, producing a spray within about three inches of the nozzle outlet. A pair of spaced apart dispensers with spray nozzles are used to spray seal the upper and lower flaps of cartons.

15 Claims, 16 Drawing Figures

HOT-MELT SPUTTERING APPARATUS

CROSS-REFERENCE TO RELATED APPLICATIONS

This application is a continuation-in-part of prior copending application Ser. No. 704,892 filed Feb. 22, 1985, now U.S. Pat. No. 4,602,741, which is a continuation of prior copending application Ser. No. 493,710 filed May 11, 1983, now abandoned.

TECHNICAL FIELD

The present invention relates to apparatus for the dispensing of viscous fluid materials and in particular to apparatus for the low pressure spraying of hot-melt adhesive material and the like.

BACKGROUND ART

Hot-melt adhesives are used in the automated packaging industry for sealing cases and cartons. Usually, melted adhesive is extruded under high pressure through a nozzle, the adhesive being applied to upper and lower major and minor flaps of cartons in long continuous strips. The use of high pressure to force hot-melt adhesives through nozzle orifices presents an occupational risk, since a rupture in the equipment could spray hot material in any direction. Further, the expense of pressure resistant hoses, fittings and couplings could be eliminated if nozzle performance, using low pressure apparatus, could equal that produced with high pressure equipment. Much attention has been devoted to improving dispensing nozzles so as to provide adequate adhesive flow at lower pressures, as well as eliminating tailing, stringing, drooling, dripping and clogging between applications.

It has been realized that continuous strips of hot-melt adhesive represent a considerable use of material. One solution is to produce a series of short dots instead of a continuous strip. In U.S. Pat. No. 3,348,520, Lockwood discloses an apparatus which produces dots of hot-melt by opening and closing valves in the nozzles at a high cycling rate. Valves in the dispensing head are responsive to the alternating high pressure stroke and suction stroke of a pump. The valve in each nozzle also ensures clean sharp closure of the nozzles, thereby preventing any tendency towards dripping. Typically, cartons in an automated assembly line travel past the hot-melt adhesive dispenser at a rate of about 400 to 600 feet per minute. The rapid and repeated opening and closing of the valves, which is required to produce short adhesive dots, is hard on the seats and valves.

In U.S. Pat. No. 4,031,854, Sprague, Jr. teaches a method in which adhesive is extruded as a band of overlapping loops. A jet providing a gas stream has a rotational component causing swirling of the extruded adhesive filament. The gas stream should be heated to about 100° F., the nozzle should be within three inches from the application surface, and the supply rate of fluid adhesive should be such that the filaments are at least two mil in diameter. Otherwise, the adhesive may harden, either before it reaches the application surface, causing stringing, or before the surfaces to be adhered are pressed together.

In U.S. Pat. No. 4,065,057, Durmann teaches an apparatus for spraying powdered heat responsive material, such as resin. The material is then melted by heated compressed air downstream of and away from the nozzle. This approach prevents problems, such as powder clumping, assoicated with apparatus which heat the material prior to being discharged from the nozzle.

Nozzle assemblies which spray melt materials have had limited success. Prior art units need to be about six inches from the application surface for proper spray formation, especially when the generally viscous hot-melt adhesives are used. However, at this distance the melt materials may cool and harden in ambient air before reaching the application surface. At low pressures, inadequate flow and improper spray formation, including misting, may occur. Misting, i.e., the production of extremely fine droplets of melt material, is undesirable for some applications, such as the sealing of cartons.

It is an object of the present invention to produce dispensing apparatus for hot-melt material which operates at low pressures and which results in a considerable saving of the amount of hot-melt material used.

It is another object of the present invention to produce a dispenser, especially for sealing boxes, which can spray preheated hot-melt adhesive onto a surface without stringing, misting or premature hardening of the material.

DISCLOSURE OF THE INVENTION

The above objects have been met with a hot-melt adhesive dispenser which sputters hot-melt adhesive, sometimes referred to simply as "hot-melt", onto surfaces at very close range. The new apparatus has nozzles which can spray drops of premelted hot-melt adhesive material at low pressure onto a surface only two or three inches away from the nozzle's outlet. Proper spray formation of hot-melt material is achieved in such short distances because a very fine stream of gas is combined axially within the hot-melt. As the hot-melt is propelled from a nozzle it is broken up into bead-like droplets by the expanding gas stream. Whereas prior art hot-melt material spray nozzles either lack a gas stream, relying on the shape of the nozzle orifice and ambient air to produce drops, or have one or more external air jets to break up hot-melt being dispensed from the nozzle, the gas stream used in the present invention is discharged from one or more hollow needles or tubular conduits forming a set of inner flow paths and the hot-melt material is discharged from an outer flow path surrounding the gas stream.

The dispenser of the present invention employs a nozzle assembly connected to a nozzle manifold where gas and hot-melt material are brought together. The manifold, in turn, is connected to a heated hot-melt dispenser head. The manifold has an inlet section with a hollow center bore for hot-melt flow from a dispenser head.

The hollow center bore is connected to a hot-melt inlet section. The bore and the outer flow path of each nozzle, defined by the interior of the nozzle itself, forms a passageway for hot-melt material from the dispenser head to the nozzle outlet. Each nozzle's inner flow paths are connected by hollow tubes to a solenoid and valve for supplying a continuous gas stream. The hollow tube supplies gas to at least one needle or the like independently supported through the hot-melt flow path so that hot-melt surrounds the tube near the gas outlet from needles in each nozzle. The emerging gas breaks up flowing hot-melt leaving the nozzle so that the emerging hot-melt droplets appear to be deposited on a surface as by sputtering, even though both the gas flow and the hot-melt flow are continuous and are not pulsed by valves or solenoids. When two or more needles or tubular conduits are present in a single nozzle, a wider spray pattern results, compared to nozzles with single needles. A square array of four needles in each nozzle is preferred. A high thermal conductivity passive heat transfer block provides a heat flow path from the dispenser head to the manifold, for maintaining the hot-melt temperature.

The nozzle assembly for box sealing applications has either a T-shaped manifold or a Y-shaped manifold, or both. A nozzle assembly with a T-shaped manifold has nozzles on the top part of the manifold distal to the dispenser head and sprays melt material on the top minor flaps of a carton. Another nozzle assembly with a Y-shaped manifold has nozzles on the top part of the manifold facing the dispenser head and sprays melt material on the bottom major flaps of the carton.

The present invention has several advantages over prior art dispensers which spray hot-melt adhesives. Because a spray of hot-melt drops forms adjacent to the nozzles, instead of about six inches away, the hot-melt material does not cool before it reaches the application surface. Also, since the hot-melt material surrounds the air stream, the gas is heated within the nozzle, thereby eliminating a major source of spray cooling. Lower gas and melt pressures are needed compared to sprayers with external air jets. The tendency of the spray to mist is also reduced.

BEST MODE FOR CARRYING OUT THE INVENTION

The present invention for the sputtering deposition of hot-melt adhesive material features a nozzle manifold assembly having spray nozzles located on a dispensing bar with both material and heat conducting paths to a heated low pressure hot-melt dispenser head. The nozzle assembly is designed to ensure that sufficient flow and proper spraying of the adhesive is maintained under low pressure hot-melt delivery conditions of below 150 pounds per square inch.

Figure 1:
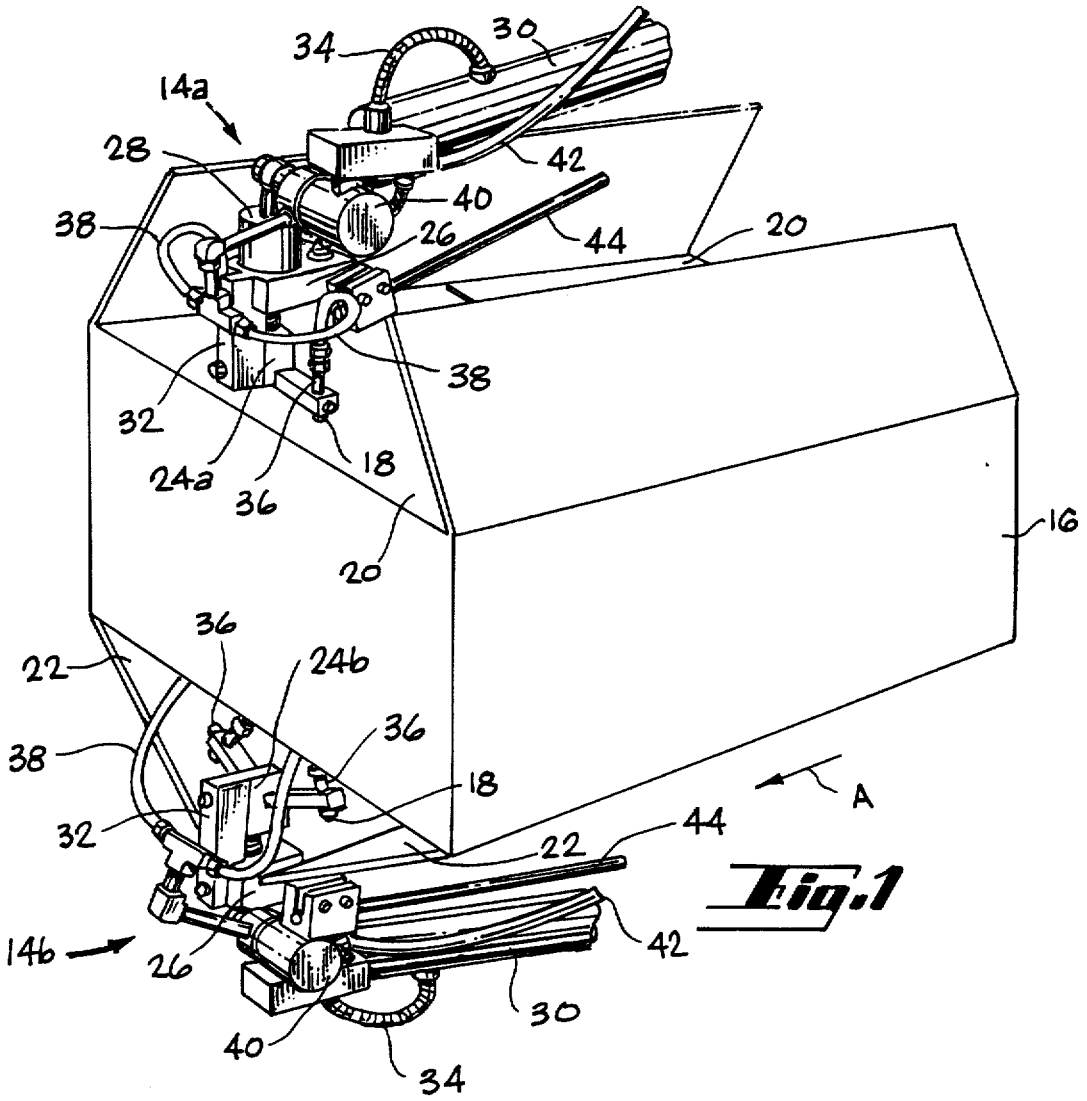
FIG. 1 is a perspective view showing the apparatus of the present invention in a carton sealing configuration for the application of hot-melt adhesive to carton flaps by using two nozzle manifolds.
Figures 2, 10:
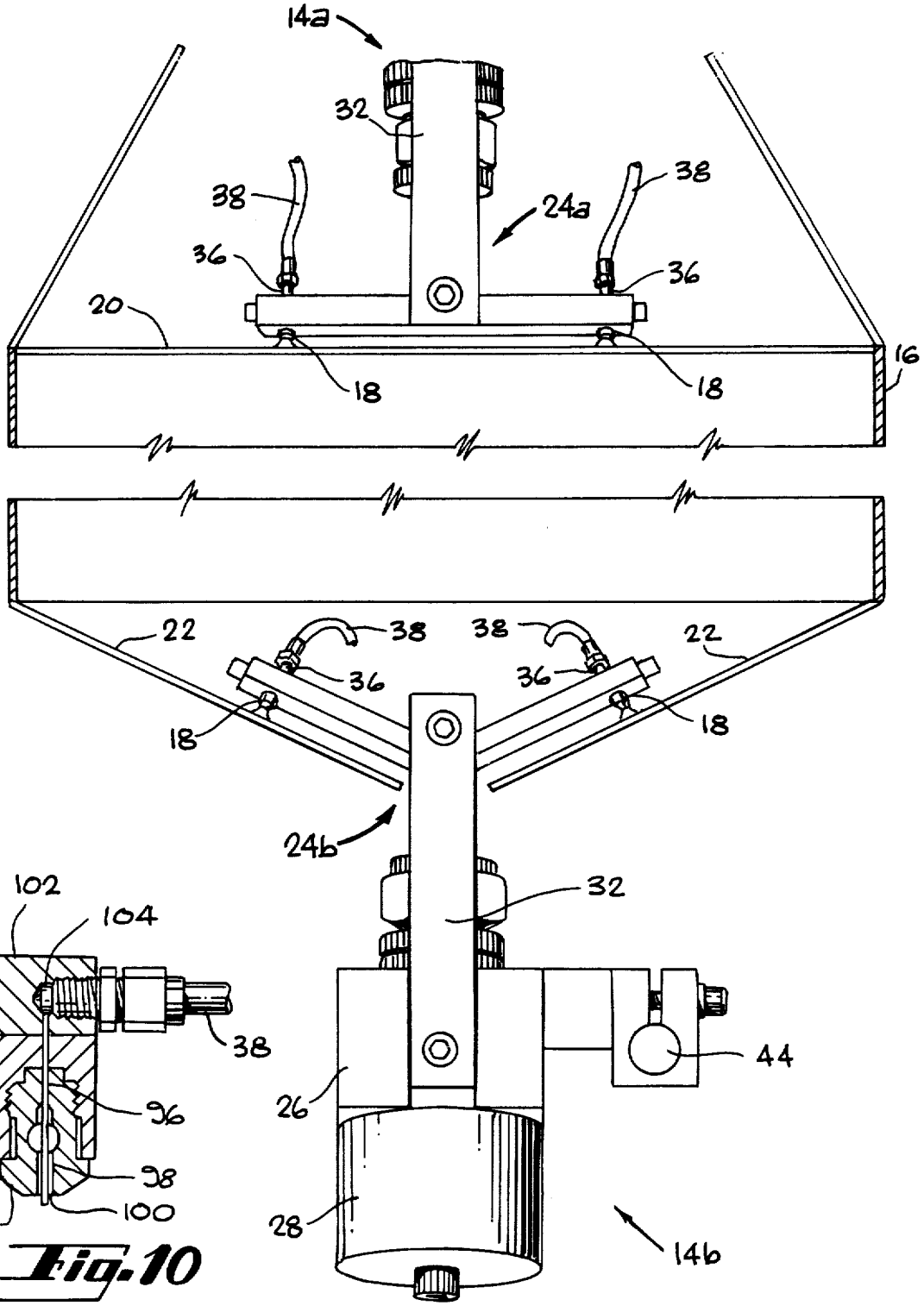
FIG. 2 is an enlarged end view of the apparatus of FIG. 1.
FIG. 10 is a partial cut-away view of a third nozzle insert.

With reference to FIGS. 1 and 2, two embodiments of the nozzle manifold assembly **14*a* and 14*b* of the present invention are shown in use in an automatic box sealing assembly line. As a carton 16 moves along rollers, not shown, in the direction of the arrow A, hot melt adhesive is sprayed from the nozzles 18 onto the outside surfaces of the top minor flaps 20 of the box and onto the inside surfaces of the bottom major flaps 22**.

Nozzle manifolds **24*a* and 24*b* are attached to fixed position heated hot melt dispenser heads 26 through which hot melt adhesive passes by means of solenoid valves 28 from heated hoses 30 connected to melting tanks, not shown. Heat transfer blocks 32 conduct heat from the heated dispenser heads 26 to the nozzle manifolds 24. These blocks should be sufficiently massive and thermally conductive to be a heat reservoir which will maintain the temperature at the nozzles 18 with a temperature drop relative to the head of 40°-50° F., without a separate heat source for the blocks. Moreover, the limited drop can be maintained for short times in the event the head momentarily loses its heat source. Dispenser heads 26 may be heated electrically with power supplied through power lines 34. Nozzles 18 receive hot-melt material from the nozzle manifolds 24 and also receive an air stream from hollow air injection needles 36. Air or other gas injection needles 36 pass through the exterior of manifolds 24 and are positioned directly in the path of hot-melt material within the interior of the nozzle body cavity, so that they terminate or have their tips at the nozzle outlets. These needles are hollow tubes having a diameter on the order of about one millimeter. Each nozzle has at least one such needle 36, but may have a plurality of needles 36. Preferably, a square array of four needles are provided in each nozzle. Larger diameter air tubes 38 connect the air injection needles 36 of an assembly to a low pressure air supply tube 42 via air solenoid valve 40**. Pressure within the needles is high compared to the supply. Air velocity is also high due to small bore of the needles, about one millimeter.

The top-apply manifold assembly **14*a* is an inverted T-shape configuration with the nozzles 18 placed on the side away from the dispensing heads 26. The bottom apply manifold assembly 14*b* is of a Y-shape with the nozzles 18 facing toward the dispenser head 26, thus facilitating spraying of the inner surface of the bottom major flaps 22 of the box. Direct contact of the nozzles 18 with the application surfaces of the box 16 is prevented by support bars 44 attached to the assemblies 14 at the dispenser heads 26. Typically, the nozzles 18** are maintained a spaced distance from the application surface of about two to three inches (5 to 7.5 cm.).

Figure 3:
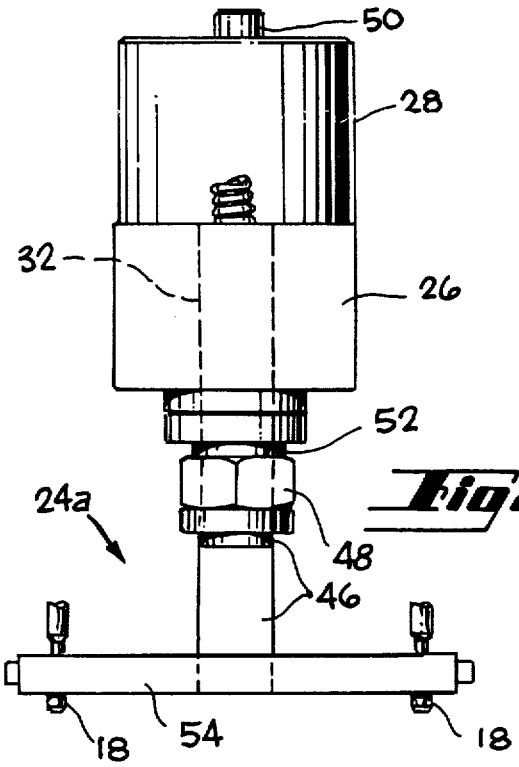
FIG. 3 is a plan view of the upper nozzle manifold of FIG. 2.
Figure 4:
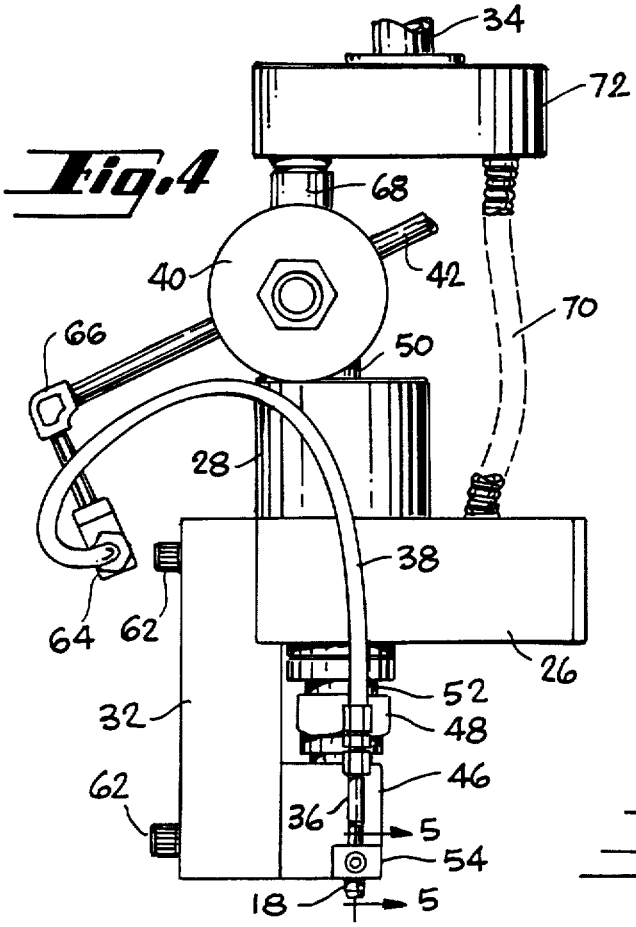
FIG. 4 is a side view of the manifold of FIG. 3.

FIGS. 3 and 4 show details of the connections between the dispenser head 26 and the nozzle manifold **24*a*. The hot-melt adhesive enters at an inlet 50 of the dispenser head 26**. After passing through solenoid valve 28 and the heated dispenser head 26, the adhesive exits through outlet 52. Dispenser heads are well known and are commercially available. An inlet section 46 of the manifold 24a, having a hollow center bore, not shown, is joined to outlet section 52 of the dispenser head 26 by means of a swivel nut 48 in a direct hot melt material dispensing line with the inlet 50 of the dispensing head 26. The swivel nut 48 allows tolerances for a leak-free attachment of inlet section of the manifold to both the dispenser head 26 and to the heat transfer block 32, shown in phantom.

Figure 5:
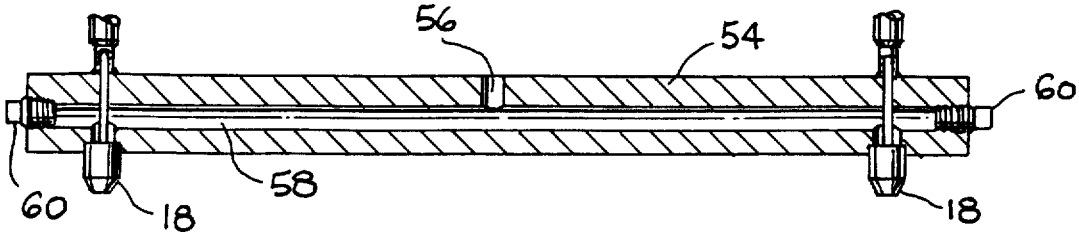
FIG. 5 is a cross section of a dispensing manifold taken along lines 5—5 of FIG. 4.

The inlet section 46 is connected to the mid-section of a rectangularly shaped dispensing bar 54 shown in lengthwise cross section in FIG. 5. The dispensing bar 54 has an inlet bore 56, which lines up with the center bore of the inlet section 46 and a longitudinal inner bore 58, which opens to the outside through multiple holes into which nozzles 18 are inserted with a braze connection. At both ends of the longitudinal inner bore 58, screws 60 are placed to facilitate cleaning of the nozzle manifold interior. Each nozzle has a central hollow body cavity leading to a nozzle outlet. The hollow body cavity defines the outer flow path for hot-melt material. The inner and outer flow paths associated with each nozzle need not terminate in identical locations. The inner path may extend slightly beyond or slightly less than the outer path. The inner path should terminate near the nozzle outlet, say within one-quarter inch The diameter of the bores 56 and 58 through the dispensing bar 54 is preferably about 0.089 inch (2.26 mm). A viable range of diameters is 0.079 inch to 0.120 inch (2.01) mm to 3.05 mm). Smaller diameters would not permit an adequate adhesive flow under low pressure delivery conditions. A larger diameter would result in poor cutoff of adhesive flow and increase the tendency of the nozzle to drool.

Figure 6:
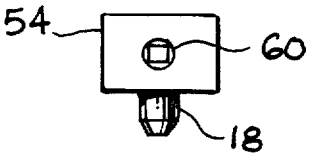
FIG. 6 is an end view of the dispensing manifold in FIG. 3.

The rectangular cross-sectional shape of the dispensing bar 54, as seen in FIG. 6, provides maximum strength while rendering a minimization of thermal radiation surface between the surrounding air and the hot-melt-adhesive-containing bores 56 and 58.

Referring again to FIG. 4, in order to maintain the adhesive in a less viscous melted condition which may be dispensed under lower pressure, it is necessary to minimize any cooling during the passage of the hot adhesive through the manifold. In addition, during periods between application, when the adhesive is held in the manifold, it is necessary to maintain it in a heated condition. To accomplish this purpose, a high thermal conductivity metal heat tranfer block 32, made of material such as aluminum, is placed in heat conducting relationship between the heated dispenser head 26 and the brass nozzle manifold inlet section 46. Heat transfer block 32 provides a heat flow path that is separate from the adhesive flow path, thereby avoiding the extra expense and complexity that would result from adding a second heating unit to the nozzle manifold assembly. Connection is made to both the head and the inlet by two screws 62 in screw holes through the block 32. Any variation in tolerances of sizes of the interconnected heat tranfer block 32 and inlet section 46 is adjusted by the swivel nut 48 of the inlet section 46 to the heated dispenser head 26 as previously described.

In order for nozzles 18 to form a spray of hot-melt within about three inches, a gas stream, preferably air, is supplied to the nozzles through hollow air injection needles 36. An air tube 38 connects in air flow communication to each air injection needle 36. The plurality of air tubes 38, each in communication with a needle 36, is in communication with an air supply tube 42 via a T-connector piece 64, an L-shaped tube section 66 and an air solenoid valve 40. This particular structure for connecting multiple tubes 38 to a single air supply tube 42 and valve 40 is not critical, and equivalent known structures may replace the T-connector piece 64 and L-shaped tube section 66 shown in FIG. 4, such as when more than two nozzles are used on a dispensing bar. Air tubes 38 are shown throughout as being external to the nozzle manifolds 24 and dispensing bar 54 with a braze connection at each nozzle location, but they may also be internal tubes which are an integral part of dispensing bar 54. The needle is parallel to and completely surrounded by the hot-melt flow path at least at the nozzle outlet, but need not be parallel elsewhere.

Solenoid valves 40 and 28 are responsive to electrical signals supplied through power lines 34 for turning on and off the flow of air and hot-melt material at the beginning and end of a job. The valves are usually not used to form hot-melt droplets because this is not necessary. The droplets are thought to be formed by gas expanding from the central core of the gas-hot-melt combination. Air solenoid valve 40 connects electrically to power lines 34 through conduit 68 and power box 72. Power to valve 28 for dispenser head 26, as well as power for heating dispenser head 26, is supplied via power box 72 and conduit 70.

Figure 7:
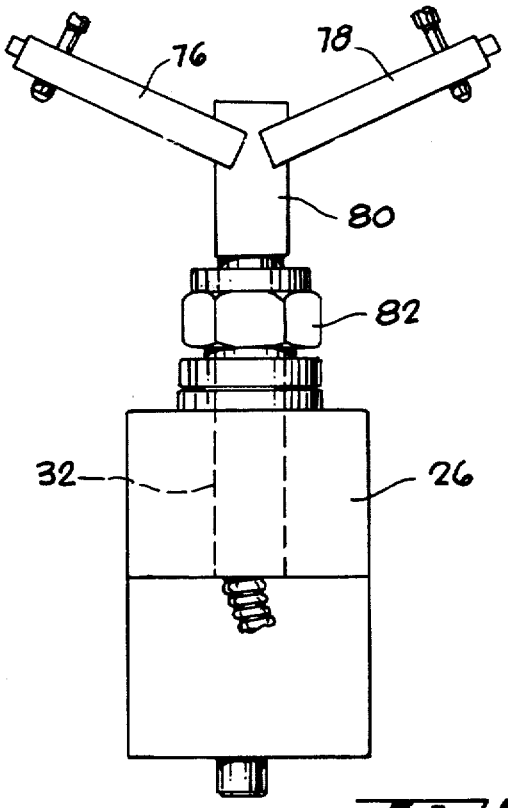
FIG. 7 is a plan view of the lower nozzle manifold of FIG. 2.

Another nozzle manifold assembly 141 for use in applying adhesive to the inner edges of the major flaps 22 at the bottom of a container is shown in FIG. 7. The dispenser bar 74 of this Y-shaped applicator assembly is split into two sections 76 and 78 and joined to an inlet section 80, which has a hollow center bore in material transfer relationship with the dispenser head 26. The center bore diverges into two bores separated by angles of usually from 110° to 130°. Each of the two sections 76 and 78 of the dispensing bar 74 are joined at one of the two outlets of the diverging bores of inlet section 80. Center bores in each bar section continue the passageway for the melted adhesive to flow out of nozzles 18 placed on the side of the dispenser bars facing toward the dispenser head 26. By this arrangement, melted adhesive may be applied to the inside edges of the partially opened bottom major flaps of the container. This embodiment has similar nozzle inserts as previously described for the top-apply nozzle manifold assembly. Likewise, a heat transfer block 32, as previously described, is employed to provide a heat flow path that is separate from the adhesive flow path.

The material used for the nozzles 18 should be steel of a similar quality to oil hardenable drill rod for long wearing durability. The swivel nut connection pieces 48 and 82, inlet sections 46 and 80 and dispensing bars 54 and 74 may be fashioned from brass. Braze connections join the nozzle inserts 18 to the dispensing bars and join the dispensing bars 54 and 74 to the inlet sections 46 and 80 respectively. In this manner, a leak-free nozzle manifold is achieved.

Each nozzle assembly may be used independently or the top apply and bottom apply embodiments may be combined as shown in FIG. 1 in an automated assembly line for sealing boxes. As the boxes pass down a conveyor belt the bottom outside flaps are folded partially and the top inside minor flaps are folded in. As the box moves along, it is sprayed by the stationary mounted top apply and bottom apply nozzle assemblies. Hot-melt adhesive is dispensed from the nozzle tips, being sprayed on the flaps in a stitch pattern of drops, resembling sputtering deposition. It is possible to control the size of the drops by adjusting the air pressure in the air injection needles 36 relative to the pressure of hot-melt in nozzle 18. Increasing the relative air pressure produces smaller drops. Preferably, drop size is adjusted to be about one-eighth inch (3 mm). Typically, the air pressure is substantially constant. However, pulsed air bursts may also be used. Using more than one gas injection needle 36 in each nozzle 18 produces a wider spray pattern than nozzles with only a single needle 36.

Figure 8:
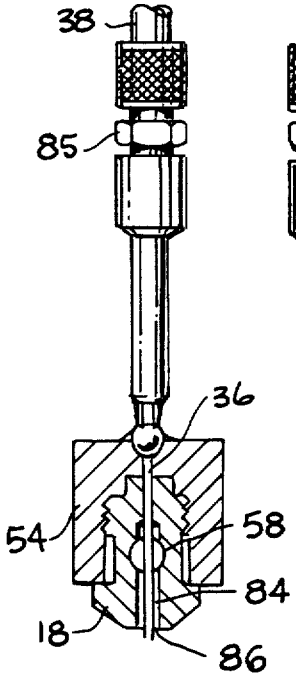
FIG. 8 is a partial cut-away view of a nozzle insert for a dispensing manifold.

With reference to FIG. 8, a nozzle 18 is seen inserted into a dispensing bar 54. A hollow air injection needle 36 is also inserted through dispensing bar 54 into nozzle 18. Nozzle 18 thus has two coaxial flow paths, an inner flow path through needle 36 for air and an outer flow path through a nozzle opening 84 for hot-melt. Needle 36 communicates with an air tube 38 so as to be supplied with a stream of air at low pressure. Nozzle opening 84 communicates with longitudinal inner bore 58 of dispensing bar 54 so as to be supplied with a stream of hot-melt material at low pressure. Both nozzle opening 84 and needle 36 terminate at a nozzle outlet 86. Needle 36 may also be adjusted by turning a swivel nut 85 so that the needle 36 terminates slightly beyond outlet 86.

Typical dimensions for nozzle 18 include a 0.095 inch (2.4 mm) diameter, 0.375 inch (9.5 mm) long nozzle opening 84 and a 0.063 inch (1.6 mm) diameter air injection needle with a 0.020 inch (0.5 mm) diameter air passage. Nozzle 18 operates at low pressure with hot-melt being at a pressure less than 150 pounds per square inch and the air stream being at a pressure less than 10 pounds per square inch. Preferably, air pressure is about 3 or 4 pounds per square inch at the supply tank.

Figure 9:
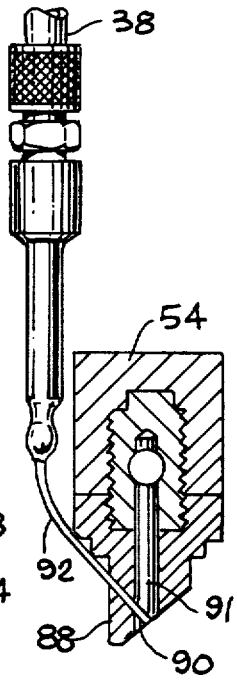
FIG. 9 is a partial cut-away view of another nozzle insert.

In FIG. 9, a nozzle 88 has an angled outlet 90. Such a nozzle may be used in a T-shaped manifold, such as manifold 54 in FIG. 3, to direct hot-melt spray at an angle. T-shaped manifolds with angled nozzles 88 may replace the Y-shaped manifold in FIG. 7 for spraying the bottom major flaps of cartons. An air injection needle 92 is curved so that an air stream flows perpendicular to outlet 90 and parallel to the flow of emitted hot-melt.

The nozzle 94 in FIG. 10 is like nozzle 18 in FIG. 8. An air injection needle 96 is positioned in nozzle 94 coaxial with nozzle opening 98. Needle 96 and opening 98 terminate at a nozzle outlet 100. At an opposite end of needle 96, the needle terminates in a block 102 where needle 96 communicates with air tube 38 for receiving a stream of air via a bore 104 in block 102. Block 102 is soldered or otherwise permanently fixed to dispensing bar 54.

In operation, the nozzles 18, 88 and 94 of FIGS. 8–10 produce a series of beads or droplets of hot-melt adhesive material ranging in size from about one millimeter, or finer, to a fraction of an inch, depending on pressure, and of general uniformity and trajectory. Once again, a stream of air is discharged from the inner flow path of needle 36, 92 or 96 at the nozzle outlet 86, 90 or 100. A stream of hot-melt material coaxially surrounds the air injection needle and flows in an outer flow path of the nozzle opening 84, 91 or 98. This hot-melt stream is projected at the outlet 86, 90 or 100, thereby producing a sputtering deposition comprising drops of hot-melt material suspended in the stream of air. The air stream aids the formation of drops by expansion at the outlet to produce a spray in a short distance. Further, since the air flow is surrounded by the hot-melt flow prior to exit from the nozzle, the air is heated. Thus, drops of hot-melt in the spray do not have a chance to cool significantly before reaching the application surface.

Figure 11:
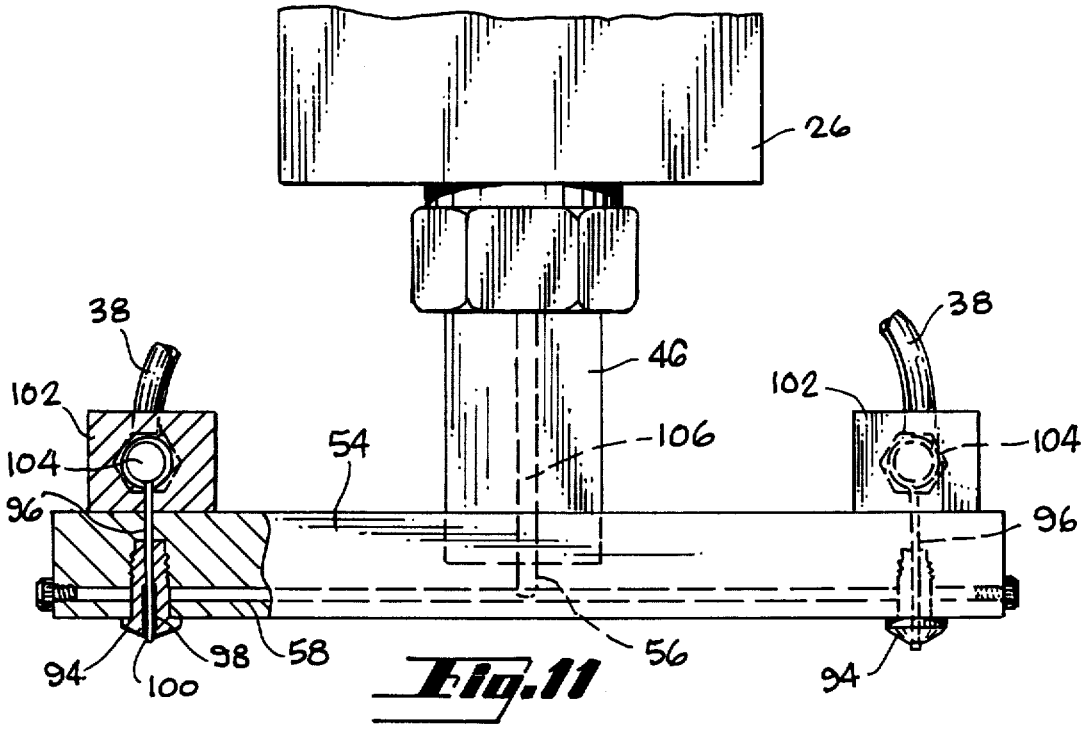
FIG. 11 is a plan view of an alternate embodiment of the upper nozzle manifold of claim 1 with the nozzle inserts of FIG. 10.
Figure 12:
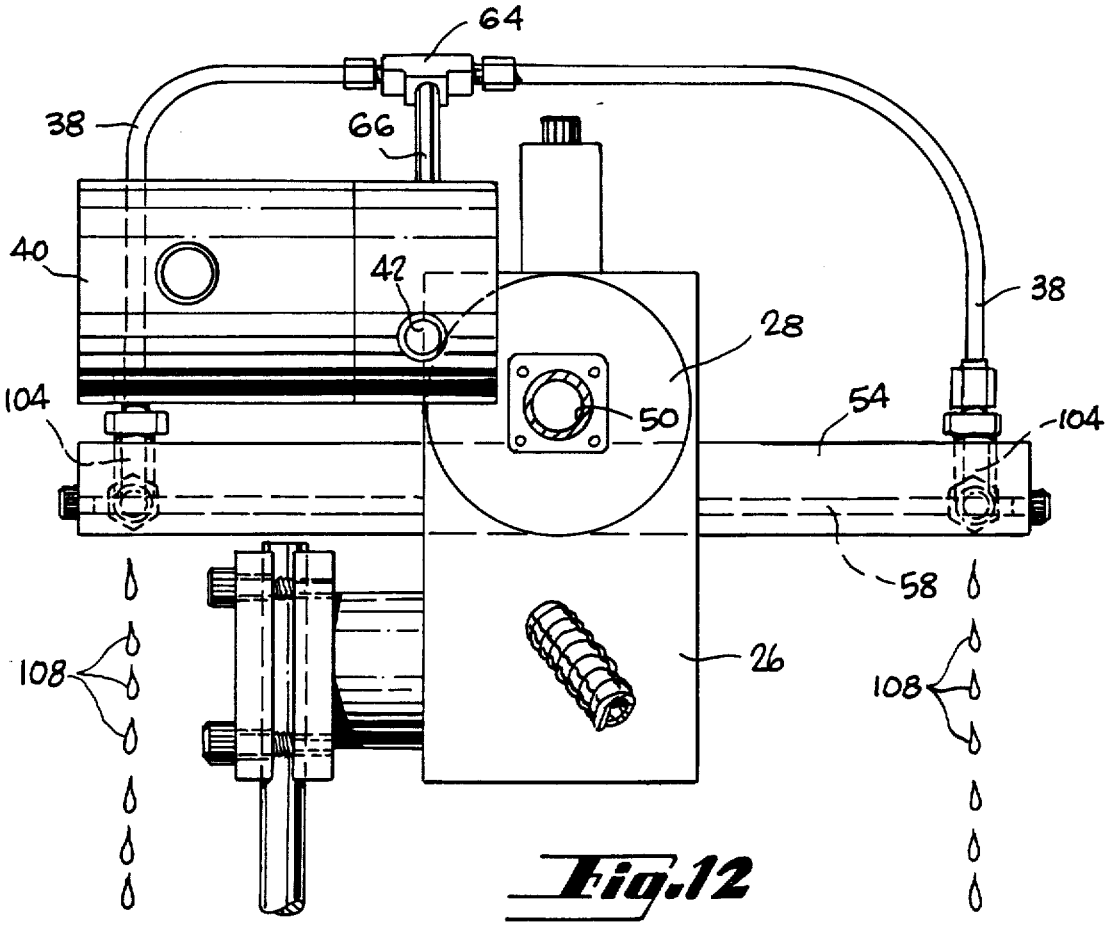
FIG. 12 is a top plan of the upper nozzle manifold of FIG. 11.

With reference to FIGS. 11 and 12, nozzles 94 are of the type shown in FIG. 10. Air flows from an air supply tube 42, into solenoid valve 40, to tube 66, and is then distributed by T-connection 64 to air tubes 38. A bore 104 in block 102 receives each tube 38 and communicates with a needle 96 in each nozzle 94 for establishing an air stream along an inner concentric flow path. Hot-melt adhesive material is supplied to nozzles 94 along a separate path. Hot-melt from a storage and melt unit, not shown, passes through inlet 50 and solenoid valve 28 to heated dispenser head 26, then flows through a hollow center bore 186 of inlet section 46, an inlet bore 56 of dispenser bar 54, longitudinal inner bore 58 to a nozzle opening 98. Thus a hot-melt material stream is established in an outer concentric flow path of nozzle 108. Heat flows along a third heat flow path including a heat transfer block 32, as seen in FIG. 4. The resulting pattern of drops 108, seen in FIG. 12, on a carton is preferably a "stitch pattern" on a moving surface which provides sufficient adhesive power with a minimum of hot-melt material.

The number of nozzles and the nozzle separation may vary. Typical constructions are a 3 inch long dispensing bar with a pair of nozzles separated by about 2.20 inches, a 2.25 inch long dispensing bar with a pair of nozzles separated by about 1.50 inches, and a 0.6 inch long bar with only a single nozzle. Dispensing bars longer than three inches may be used with more than two nozzles provided the heat transfer block is flared so as to efficiently transfer heat to the ends of the dispensing bars.

Figure 13:
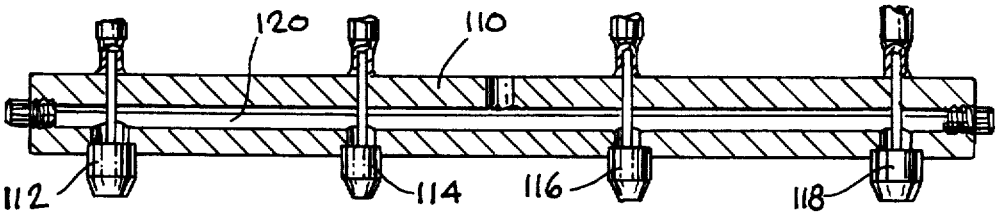
FIG. 13 is a cross section of an alternate embodiment of a dispensing manifold for the apparatus of FIG. 1.

In FIG. 13, a dispensing bar 110 has four nozzles 112, 114, 116 and 118, instead of the two nozzles 18 in the dispensing bar 54 of FIG. 5. Dispensing bar 110 may be used wherever dispensing bar 54 is called for. Dispensing bars with more than two nozzles should have larger orifice nozzles at the edges of the bars so as to dispense equal amounts of hot-melt at all of the nozzles. This is because hot-melt material pressure, in bore 120 of dispensing bar 110, is lower at edge nozzles 112 and 118 than at center nozzles 114 and 116, causing reduced hot-melt flow to edge nozzles 112 and 118. Nozzles 112 and 118 have greater diameter bores compared to nozzles 114 and 116 in order to compensate for the reduced pressures.

Figure 14:
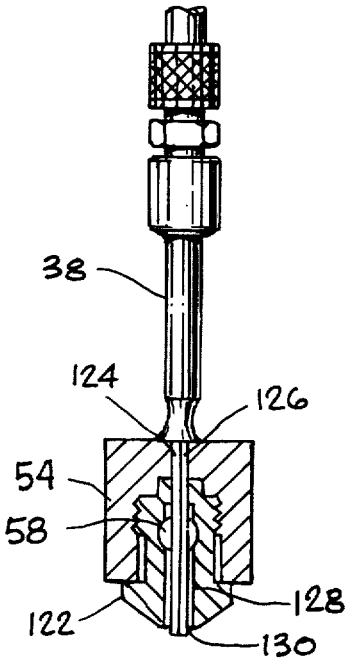
FIG. 14 is a partial cut-away view of a fourth nozzle insert for a dispensing manifold.

With reference to FIG. 14, a nozzle 122 is seen inserted into a dispensing bar 54. Two hollow gas injection needles 124 and 126 are also inserted through dispensing bar 54 into nozzle 122. Nozzle 122 thus has three flow paths, two inner flow paths through needles 124 and 126 for gas, such as air, and an outer flow path through a nozzle opening 128 for hot-melt. Both needles 124 and 126 communicate with a tube 38 so as to be supplied with a stream of gas at low pressure. Nozzle opening 128 communicates with longitudinal inner bore 58 of dispensing bar 54 so as to be supplied with a stream of hot-melt material at low pressure. Both needles 124 and 126 terminate at or just beyond a nozzle outlet 130. While nozzle 122 is described as having two needles 124 and 126, other numbers of needles may also be used. Using more than one gas injection needle in a nozzle produces a wider spray pattern than nozzles in FIGS. 8–10 using only one needle. Thus, two needles 124 and 126 produce a wide spray pattern, three needles produce an even wider spray pattern, and so forth.

Figure 15:
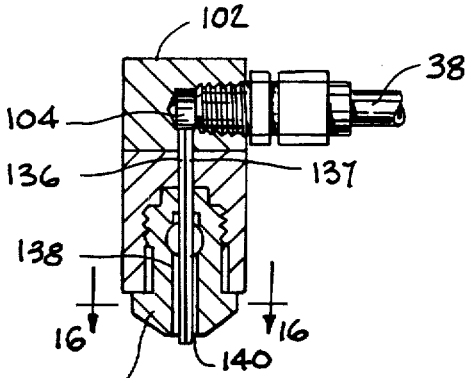
FIG. 15 is a partial cut-away view of a fifth nozzle insert.
Figure 16:
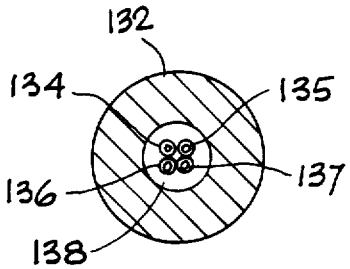
FIG. 16 is a cross sectional view of a nozzle insert taken along lines 16—16 in FIG. 15.

With reference to FIGS. 15 and 16, a nozzle 132 has four gas injection needles 134, 135, 136 and 137 inserted through a nozzle opening 138. Nozzle 132 thus has four inner flow paths through needles 134, 135, 136 and 137 for air or some other gas, and an outer flow path through nozzle opening 138, surrounding the inner flow paths, for hot-melt. All four needles 134, 135, 136 and 137 terminate at or slightly beyond a nozzle outlet 140. Nozzle 132 is inserted into a dispensing bar 54, and a block 102 is affixed to dispensing bar 54. Needles 134, 135, 136 and 137 terminate in block 102 where they communicate with air tube 38 for receiving a stream of air via bore 104 in block 102.

In operation, nozzles 122 and 132 in FIGS. 14–16 produce a hot-melt spray in much the same manner as nozzles 18, 88 and 94 in FIGS. 8–10. A stream of air is discharged from a set of inner flow paths in hollow gas injection needles 124 and 126 or 134, 135, 136 and 137. A stream of hot-melt material surrounds the plurality of needles, flowing in an outer flow path of nozzle opening 128 or 138. This hot-melt stream is projected at outlet 130 or 140, thereby producing a sputtering deposition comprising drops of hot-melt material suspended in the stream of air. The air stream aids the formation of drops by expansion at the outlet to produce a spray in a short distance. Because the air stream is distributed among a set of inner flow paths, air expansion produces a wider spray pattern than one produced by nozzles with a single inner flow path. Wider spray patterns are preferred for sealing flaps of cartons in which maximum adhesive strength is desired with a minimum of material.

While the apparatus of the present invention has been described with reference to the spraying and sputtering of hot-melt adhesives, the same apparatus can be used for other viscous fluids.

I claim:

1. An apparatus for the spraying of hot-melt material or the like comprising, a nozzle having a hot-melt material path and a plurality of gas flow paths and having a nozzle outlet, said hot-melt material path terminating at said nozzle outlet, said gas flow paths defining inner flow paths being suppliable with a stream of gas, said hot-melt material path defining an outer flow path surrounding said inner flow path at said nozzle outlet and being separately suppliable with a stream of hot-melt material, said inner flow paths extending at least as far as said nozzle outlet, said stream of hot-melt material being projectable into the surrounding atmosphere from said outer flow path at said nozzle outlet, the gas breaking up said stream of hot-melt material into an area-wide spray of droplets.

2. The apparatus of claim 1 wherein the outer flow path is defined by a central, hollow nozzle body cavity and th einner flow path is defined by at least two tubular gas flow conduits extending at least partially through the hollow nozzle body.

3. The apparatus of claim 2 wherein an array of four tubular conduits extend through said nozzle, said array being coaxial with said outer flow path.

4. An apparatus for the spraying of hot-melt material or the like comprising, a plurality of nozzles, each of said nozzles having a hot-melt material flow path and a plurality of tubular gas flow conduits and having a nozzle outlet, sid hot-melt material flow path terminating at said nozzle outlet, said tubular gas flow conduits defining an inner flow path suppliable with a streamof gas and said hot-melt material flow path defining an outer flow path surrounding said inner flow path at said nozzle outlet and being separately suppliable with a streamof hot-melt material, said inner flow path extending at least as far as said nozzle outlet, said stream of hot-melt material being projectable from said outer flow path at said nozzle outlet, the gas producing a spray of drops of hot-melt material from said outlet, a nozzle manifold connected to a heated hot-melt dispenser head in a hot-melt material transfer relationship, said plurality of nozzles being connected to said nozzle manifold, said manifold having an inlet section and a dispensing member connected to said inlet section, said inlet section and said dispensing member each having a hollow center bore, said hollow center bore of said manifold and said outer coaxial flow paths of said nozzles forming a passageway for hot-melt material from said dispenser head, and means for supplying a gas stream to each of said inner flow paths of said nozzles.

5. The nozzle assembly of claim 4 wherein said means for supplying an air stream comprises, a plurality of gas tubes, each gas tube being in gas flow communication with said inner flow path of one of said nozzles, and means for supplying low pressure gas and controlling gas flow through said plurality of air tubes.

6. The nozzle assembly of claim 4 wherein said gas is supplied at a pressure of less than ten pounds per square inch measured at a gas supply vessel.

7. The nozzle assembly of claim 4 wherein said hot-melt material is supplied at a pressure of less than 150 pounds per square inch.

8. The nozzle assembly of claim 4 wherein said inner flow path is define by a square array of four tubular gas flow conduits extend through said nozzle, said array being coaxial with said outer flow path.

9. An apparatus for the spraying of hot-melt material or the like using a low pressure, heated dispenser head comprising, a nozzle manifold connected to a heated hot-melt dispenser head in a hot-melt material transfer relationship, said manifold having an inlet section, a dispensing member and at least one hollow nozzle, said inlet section and dispensing member each having a hollow center bore, the hollow nozzle having an opening which connects with said hollow center bores to form a passageway to material in said dispenser head, said hollow nozzle also having a gas flow conduit means extending through ®air nozzle opening for providing a gas stream at the outlet of said nozzle, said gas flow conduit means including an array of hollow gas injection needles inserted into said dispensing member and extending through said hollow nozzle coaxially with said nozzle opening, said hot-melt material terminally surrounding said gas stream, breaking up a stream of hot-melt material into droplets up being discharged from said nozzle.

10. The nozzle assembly of claim 9 wherein said dispensing member is perpendicular to said inlet section thereby forming a T-shaped manifold, with a T-base defined by said inlet section connected to said dispenser head, and with a T-top defined by said dispensing member, said nozzle openings being on a side of said T-top distal to said dispenser head.

11. The nozzle assembly of claim 9 wherein said manifold is formed in a Y-shape, with a Y-base defined by said inlet section connected to said dispenser head and with a Y-top defined by said dispensing member, said Y-base demarcating two portions of said Y-top formed at an angle between 110 and 130 degrees, said nozzle openings being on a side of said Y-top facing said dispenser head.

12. In an automated assembly line for the hot-melt adhesive sealing of cartons with top and bottom flaps, in which hot-melt material is dispensed from a heated dispenser, a hot-melt spray system comprising, a first nozle assembly means for directing hot-melt material onto top flaps of a carton, said first nozzle assembly means having a first nozzle manifold and a firt plurality of nozzles delivering a hot-melt outflow stream, said first nozzle manifold connected to a first heated hot-melt dispenser head in a hot-melt transfer relationship, a second nozzle assembly means spaced apart from the first nozzle assembly means for directing hot-melt material onto bottom flaps of said carton, said second nozzle assembly means having a second nozzle manifold and a second plurality of nozzles delivering a hot-melt outflow stream, said second nozzle manifold connected to a second heated hot-melt dispenser head in a hot-melt transfer relationship, means for injecting a gas stream coaxially within the hot-melt outflow streams of the first and second nozzle assembly means, thereby breaking up a stream of hot-melt material, said means for injecting a gas stream including a plurality of tubular gas flow conduits, there being at a least two tubular gas flow conducts in each nozzle, each tubular gas flow conduit being parallel to said hot-melt outflow stream within at least a portion of one of said nozzle, and means for supplying gas into said plurality of tubular gas flow conduits.

13. A method of applying hot-melt material or the like from a nozzle having an inner flow path and an outer flow path comprising, advancing a flow of premelted hot-melt material through a nozzle, supplying a stream of gas to a plurality of gas flow paths, each being parallelly disposed within the hot-melt flow at said nozzle, expanding said stream of gas in the atmosphere closely adjacent to said nozzle, thereby providing a sputtering force to said hot-melt material, and breaking up the flow of hot-melt material into an area-wide spray of droplets by said expansion of the stream of gas.

14. The method of claim 13 wherein said flow of hot-melt material through a nozzle is substantially continuous.

15. The method of claim 13 wherein said stream of gas through the plurality of gas flow paths is a substantially continuous stream.

* * * * *

UNITED STATES PATENT AND TRADEMARK OFFICE

CERTIFICATE OF CORRECTION

PATENT NO. : 4,721,252

DATED : January 26, 1988

INVENTOR(S) : Douglas E. Colton

It is certified that error appears in the above—identified patent and that said Letters Patent is hereby corrected as shown below:

Column 1, line 68, "assoicated" should read - -associated- -.

Column 5, line 32, "(2.01) mm to 3.05 mm)." should read - -(2.01 mm to 3.05 mm).- -.

Claim 2, column 9, line 57, "and th einner flow path" should read - -and the inner flow path- -.

Claim 4, column 9, lines 67-68, "a nozzle outlet, sid hot-melt" should read - -a nozzle outlet, said hot-melt- -.

laim 4, column 10, line 2, "a streamof" should read - -a stream of- -.

laim 8, column 10, line 39, "is define by" should read - -is defined by- -.

laim 9, column 10, line 54, "extending through Rair" should read - -extending through said- -.

laim 9, column 10, line 62, "into droplets up being" should read - -into droplets upon being- -.

laim 12, column 11, line 15, "a first nozle assembly" should read - -a first nozzle assembly- -.

laim 12, column 11, line 18, "a firt plurality" should read - -a first plurality- -.

UNITED STATES PATENT AND TRADEMARK OFFICE

CERTIFICATE OF CORRECTION

PATENT NO. : 4,721,252

DATED : January 26, 1988

INVENTOR(S) : Douglas E. Colton

It is certified that error appears in the above-identified patent and that said Letters Patent is hereby corrected as shown below:

Claim 12, column 12, line 5, "flow conducts" should read -- flow conduits --.

Signed and Sealed this

Fifth Day of July, 1988

*Attest:*

*Attesting Officer*

DONALD J. QUIGG

*Commissioner of Patents and Trademarks*